US006380153B1

(12) United States Patent
Carlson

(10) Patent No.: US 6,380,153 B1
(45) Date of Patent: Apr. 30, 2002

(54) METHODS FOR PRODUCING SURFACTANTS WITH CELLULOSE COMPOSITIONS

(76) Inventor: Chris Carlson, 2747 S. 2700 East, Salt Lake City, UT (US) 84109

( * ) Notice: Subject to any disclaimer, the term of this patent is extended or adjusted under 35 U.S.C. 154(b) by 0 days.

(21) Appl. No.: 09/771,864

(22) Filed: Jan. 29, 2001

Related U.S. Application Data

(60) Provisional application No. 60/198,684, filed on Apr. 20, 2000.

(51) Int. Cl.[7] ..... C11D 13/00
(52) U.S. Cl. ..... 510/460; 510/344; 510/438
(58) Field of Search ..... 510/344, 399, 510/437, 460, 438

(56) References Cited

U.S. PATENT DOCUMENTS

| | | | | | |
|---|---|---|---|---|---|
| 2,353,686 | A | * | 7/1944 | Brown | 252/368 |
| 3,663,583 | A | | 5/1972 | Haynes | |
| 4,075,234 | A | | 2/1978 | Peterson | |
| 4,129,520 | A | | 12/1978 | Peterson | |
| 4,397,760 | A | | 8/1983 | Story et al. | |
| 4,404,015 | A | * | 9/1983 | Menon et al. | 71/77 |
| 4,772,434 | A | | 9/1988 | Myers | |
| 4,837,381 | A | * | 6/1989 | Steber et al. | 424/502 |
| 5,386,045 | A | | 1/1995 | Weerasooriya | |
| 5,688,930 | A | | 11/1997 | Berto et al. | |
| 5,990,074 | A | | 11/1999 | Gross et al. | |
| 6,020,509 | A | | 2/2000 | Weerasooriya et al. | |

OTHER PUBLICATIONS

C. Failer; "*Making Natural Liquid Soaps*"; pp. 133; Copyright 2000; Publisher—Storey Books.

* cited by examiner

*Primary Examiner*—John Hardee
(74) *Attorney, Agent, or Firm*—Morriss, Bateman O'Bryant & Compagni

(57) ABSTRACT

Methods of producing surfactant compositions are disclosed in which processed plant material is used to enhance the saponification process to produce surfactant compositions having enhanced surfactant, mechanical cleaning and emollient characteristics. The plant material provides additional oils and triglycerides for reaction in the saponification process and provides an improved reaction interface, thereby producing surfactant compositions of improved character.

28 Claims, No Drawings

METHODS FOR PRODUCING SURFACTANTS WITH CELLULOSE COMPOSITIONS

This application claims benefit of Prov. No. 60/198,684 filed Apr. 20, 2000.

BACKGROUND OF THE INVENTION

1. Field of the Invention

This invention relates to a process for the production of surfactant compositions, in particular, to a process whereby surfactants, emollients and abrasive agents are created from the addition of natural plant materials to a triglyceride saponification reaction or a free fatty acid reduction reaction.

2. Description of Prior Art

The saponification of triglycerides to make carboxylate salts for use as surfactants is well known in the art. The carboxylate salts resulting from this saponification have been demonstrated to be effective in removing oils, dirt and other substances from surfaces. Many improvements to this basic surfactant composition have also been made.

For instance, it has been demonstrated that alkoxylation of triglycerides and the subsequent saponification of this reaction product give carboxylate salts that are milder on epidermal tissue, without losing the desired surfactant qualities. U.S. Pat. No. 5,386,045 discloses a method for alkoxylating triglycerides by reacting an alkylene oxide, such as ethylene oxide, with a triglyceride having the formula:

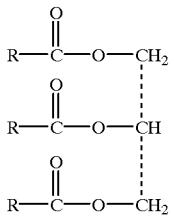

to create an alkoxylated triglyceride of the formula:

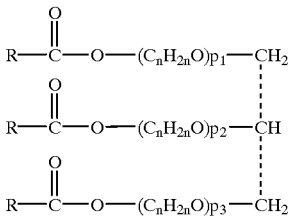

where R stands for the fatty acid portion of the triglyceride containing from about 6 to about 30 carbon atoms, n is from 2 to 4 and $p_1$, $p_2$ and $p_3$ are each from about 1 to about 50, preferably 1 to 15. As noted above, the saponification product of this alkoxylated triglyceride has improved mildness. It would be desirable to create an equally or surpassingly mild surfactant composition in which the quality of the surfactant is also improved. The invention disclosed in U.S. Pat. No. 5,386,045 does not, however, meet that objective.

Other improvements in the process for creating surfactant compositions involve placing certain stresses on the saponification process and utilizing equipment that improves the rate and yield of saponification. For instance, U.S. Pat. Nos. 4,397,760 and 4,772,434, among others, describe means for increasing the speed with which the saponification process proceeds. These steps increase the complexity of the saponification process without increasing the qualities of the surfactant composition products. Though increasing yield and rate of saponification and reduction are certainly good objectives, it would be desirable to improve the resultant surfactant composition while retaining the simplicity of the saponification process.

Free fatty acid molecules can also be reacted to create carboxylate salts, and a mixture of the reaction products of triglyceride saponification and free fatty acids has been found to make a good surfactant composition. U.S. Pat. No. 5,990,074 describes a process whereby free fatty acids and triglycerides are combined and the resulting solution is then reacted with an alkali base catalyst. This simultaneously saponifies the triglycerides and neutralizes the free fatty acids, creating a mixture of carboxylate products in an essentially one-step reaction. U.S. Pat. No. 5,990,074 states as its objective the creation of a cost saving reaction that will result in a product having carboxylates from both neutralization and saponification. This does not, however, increase the surfactant quality of the resulting surfactant composition, since it is made only of carboxylate ions, and it does not improve the emollient nature of the surfactant composition. It would be desirable to create a similarly simple process, though improving it such that higher quality surfactants, emollients and abrasive agents are also produced. Creating such agents from a triglyceride saponification and/or free fatty acid reaction would improve the resulting surfactant composition while retaining the simplicity of the reaction.

Partial saponification of alkoxylated triglycerides, with retention of all saponification products, has been demonstrated to increase the emollient nature of the resulting surfactant composition. U.S. Pat. No. 6,020,509 discloses a method of producing surfactant compositions with increased moisturizing characteristics. This is accomplished by saponifying an alkoxylated triglyceride mixture with alkali base catalyst in a molar ratio of 1:1 to 1:2.5. To fully saponify a mole of triglyceride, the molar ratio of triglyceride to alkali base would have to be at least 1:3, allowing enough hydroxide molecules to cleave the three bonds on each triglyceride molecule. Such partial saponification leaves mono- and diglycerides in the final surfactant composition, and these are collected along with the surfactant carboxylate salts. The mono- and diglycerides retain moisture, adding an emollient nature to the surfactant composition. This method does not, however, create improved surfactants with better cleaning characteristics, and it does not create mechanical agents that can act abrasively to more effectively remove unwanted materials from epidermal tissue.

It is also well known in the art to utilize synthetic surfactants that, among other characteristics, improve the cleaning capabilities of surfactant compositions. For instance, alkanesulfonates and alkyl hydrogen sulfates are often used in soaps to increase the surfactant nature. These synthetic surfactants are often damaging to epidermal tissues and in many cases can contribute to the development of chronic dermatitis. Likewise, silicates and minerals added to soap products as surfactants and as mechanical agents to remove unwanted substances can also damage epidermal tissues. It would be desirable to create surfactant compositions in which the improved surfactants and mechanical agents do not damage epidermal tissue. It would be even more desirable to create such improved surfactant compositions where the additional agents actually improve the condition of epidermal tissue.

In addition to potentially harmful effects on epidermal tissues, the production of many synthetic and natural surfactant, mechanical and emollient additives increases the complexity of surfactant composition production. For example, U.S. Pat. Nos. 4,129,520 and 4,075,234 involve the creation of carboxylate salts from organic acids through the use of alkyl nitriles. These processes require that the excess alkyl nitrile then be removed before the surfactants can be utilized. This adds steps to the saponification process and, thus, the cost of processing. Commonly utilized alkanesulfonates and other synthetic additives also must be created in additional steps, and are often expensive to synthesize.

Another example of this increase of complexity has been seen in a process for creating alkyl pentosides derived from wheat by-products, which are then added to natural or synthetic surfactant compositions. U.S. Pat. No. 5,688,930 discloses such a process. In that process, the main ingredient for creating alkyl pentosides is wheat fiber, which is described as any material derived from the transformation of wheat, namely bran and some starches. The bran is composed of hemicellulose, which is in turn made up of xylose and arabinose monomers and cellulose. Using wheat straw is also described. The disclosed process involves reacting this wheat fiber or straw with aqueous acid solution for a period of time at a described temperature in order to make a pentose syrup. The residual wheat pulp is strained from the syrup, and the pentose syrup is then further reacted with an alcohol of between 6 and 22 carbon atoms. The resulting surfactant pentosides are then separated from the solution and added to another surfactant composition.

U.S. Pat. No. 5,688,930 states as an object the production of surfactant agents from a cheap, raw material. It does not create molecules of increased surfactant, emollient or mechanical characteristics, and since it is a separate step apart from the creation of surfactant compositions, it only further complicates, rather than retains the simplicity of, many surfactant composition-creating processes. It would be desirable to create surfactant compositions with improved surfactant, emollient and mechanical characteristics utilizing a process that would retain the simplicity of triglyceride saponification and/or free fatty acid neutralization.

BRIEF SUMMARY OF THE INVENTION

In accordance with the present invention, a process is provided for improving the surfactant, mechanical and emollient properties of surfactant compositions by introducing natural plant materials into the saponification of triglycerides or reaction of free fatty acids. The surfactant compositions produced by the methods disclosed herein display improved cleaning capabilities and improved emollient properties over prior known surfactant compositions not containing plant material.

According to the methods of the present invention, a source of triglycerides or free fatty acids is reacted with an alkali base, usually either NaOH (sodium hydroxide) or KOH (potassium hydroxide), in the presence of processed plant material to release molecular components of the plant material which enhance and improve the surfactant, mechanical and emollient properties of the resulting surfactant composition. The disclosed reaction saponifies the triglyceride mixture, or reduces the free fatty acid mixture, while breaking up the plant material to free molecular components which provide improved surfactant, mechanical and emollient properties.

The triglyceride solution may be composed of any triglyceride commonly utilized in the production of surfactant compositions. The free fatty acid solution may be composed of any of the free fatty acids commonly used in the production of surfactant compositions. Both the triglycerides and the free fatty acids preferably have alkyl groups within the 12 to 18 carbon range and can be normal or branched, with a preference for normal alkyl groups. The type of triglyceride used will also dictate the characteristics of the surfactant compositions. For example, olive oil provides especially enhanced emollient character to soaps in comparison with other types of oils.

Any plant material may potentially be used in the surfactant compositions of the present invention. The plant material is processed prior to use in the saponification reaction to assure a clean, contaminant-free biomass of material. Notably, processed plant material may also be added post-reaction to provide a surfactant composition with improved cleaning capabilities. Additional plant material, comprising up to 62% by weight of the final product, may be added following saponification. The surfactant compositions of the invention range in pH from about 7.0 to 10.0.

While any plant material may be used in the methods of the present invention, grasses may be particularly ideal for use in the disclosed methods because grasses contain natural triglycerides and cellulose structure which provides improved characteristics to the surfactant products. When grasses are reacted with an alkali base, the reaction cleaves the cellulose structure of the grass and releases into solution water, lipids and cellulose fibers (lignin), each of which improves the properties of the surfactant compositions. The released water is available for reaction in the saponification process and quenches the saponification reaction to draw the grass into reaction, thereby adding to the chemical cleaving of the grass. The lipids released from the grass provide an ideal source of additional triglycerides or fatty acids for the saponification process. Additionally, the cellulose fibers provide a reaction interface for the lye solution in the saponification process and produce "mechanical surfactants," or surfaces which contact the interface between the skin and the surfactant to mechanically dislodge or remove dirt and particulates from the skin, without abrading the skin or causing dermatitis. The grass also provides chlorophyll to the finished product which acts as a natural antiseptic.

"Grass," as used herein, refers to species which include everything from Bamboo to common lawn grasses. Bamboo and hemp fibers are ideal for long fiber production and can be used; however, their length (R>>26), tough cellulose structures and low lipid/water content (<65%) renders them less susceptible to fully participating in reaction to provide surfactants in the R=1 to 26 range.

Common lawn grasses such as rye grass or bent grass have very little fiber and are higher in lipid/water content (70–80% water, 8–10% lipids, 10–20% fiber). These grasses can also be used in the reaction. However, their low fiber, high lipid/water content cause them to freely break apart in reaction leaving few long chain surfactants (R is mostly <26). These grasses provide an adequate soap base for cosmetic applications. These grasses may also be added post reaction for a more gentle composition.

The most effective embodiments of the current invention contain fibrous species of the Poacea family and some crab grasses. Exemplar types of these grasses include Bermuda grass, bluegrass, fescue grass and bearded crouch grass (a crabgrass). These varieties of grasses have moderately fibrous cellulose structures and moderate lipid/water content (65–75% water, 6–8% lipids, 17–30% fiber). These varieties of grass participate in the reaction, providing ideal surfactant compositions (R=6 or larger). When added post reaction, these grasses provide significantly enhanced "mechanical surfaction" while not abrading the skin. These grasses would then be ideal for heavy-duty grease or soil removal for mechanics, gardeners, etc.

The fragments of cellulose provided in the surfactant compositions of the present invention act as mechanical agents in the surfactant compositions. By "mechanical agents" is meant that the material acts to remove surface-borne particles mechanically rather than chemically. Like the known minerals and silicates which are typically put in surfactant compositions, these natural cellulose fragments act mechanically to remove unwanted materials that other surfactants cannot. Unlike added minerals and silicates, however, the fragments of cellulose are much milder on the skin and do not cause such conditions as chronic dermatitis, which is sometimes associated with these other additives. In trials, the soaps made by the current process have actually helped clear up cases of chronic dermatitis caused by overuse of other surfactant compositions. In addition to the cellulose fragments resulting from the saponification process, processed plant material can be introduced into the final surfactant composition of the present invention to provide mechanical agents which increase the mechanical quality of the surfactant composition. Small fragments of cellulose are also present for mechanically enhancing the surfactant composition. Other components of the plant materials, such as phenylpropanoids and lignin molecules, also have surfactant characteristics.

The process of the present invention retains the simplicity of the saponification process while producing surfactant compositions of improved quality and surfactant character. Addition of plant material to a saponification reaction results in a surfactant composition that is high in quality surfactants, as well as high in mechanical and emollient agents that are beneficial to the skin. Surfactant compositions with these characteristics are attained without the addition of extraneous or unnatural ingredients, and in a simple process.

According to the present invention, plant material that has been boiled, milled and drained to remove excess water is added to a mixture of triglycerides. The triglycerides may be either unmodified, alkoxylated or otherwise modified. The mixture is stirred to bring the plant pieces into solution. The solution is then heated. In a "cold process", the solution is heated to about 45° C. and in a "hot process", the solution is heated to about 71° C. The lye solutions are then prepared by addition of a hydroxide to water. For example an aqueous sodium hydroxide solution is allowed to cool to 28° C. or an aqueous potassium hydroxide solution is allowed to cool to 60° C. before use. The cooled lye solution is then added to the heated grass/triglyceride mixture. The saponification reaction is then allowed to run its course. Notably, additional plant material may be added during the saponification reaction, but it not strictly required. The surfactant composition may be diluted to form a liquid surfactant or may be gelled to form a more viscous liquid form, or may be allowed to cure into wholly or substantially solidified bars. Free fatty acids can also be used in place of or with triglycerides, and these are then reacted using aqueous alkali base to form carboxylate salts, or saponification.

Potassium hydroxide as the basis for the lye solution is preferred for making liquid soap where additional plant material is introduced at the end of the process since its crystalline structure allows more of this material to be suspended in the final product. Sodium hydroxide as the basis for the lye solution is preferred for the production of bars because its crystalline structure is much tighter and it forms a more solidifiable end product. Either alkali base, or other bases, can be used, however, to make liquid or bar soap according to the process of the present invention.

The reaction kinetics of potassium hydroxide and sodium hydroxide bases differ in the saponification reaction where plant material is placed into the solution. When potassium hydroxide is used in the lye solution, the reaction proceeds fairly rapidly and the mixture expands as the hydroxide ions interface with the plant material. The plant material is ultimately consumed in the reaction and the solution remains thin in consistency until about forty minutes into the reaction. By then, the soap precipitants in the solution begin to form a critical radius size and propagate throughout the solution leading to a thickening of the solution at about one hour into the reaction time. When lye solution containing sodium hydroxide is used in a hot process of saponification, the reaction is rapid as is observed with potassium hydroxide. By contrast, when sodium hydroxide is used in lye solution and in a hot process, the reaction is of lower energy and the plant material is not wholly cleaved. When sodium hydroxide is used in the lye solution and in a cold process, the reaction is of lower energy and proceeds more slowly, thereby cleaving plant material to an even lesser extent during solidification.

The ratio of alkali base to triglyceride/plant material mixture can be varied to achieve a desired ratio of surfactant to moisturizing mono- and diglycerides. Thus, a ratio of about 45% to 65% aqueous KOH to triglyceride/plant material solution, or about 30% to 50% aqueous NaOH to triglyceride/plant material solution will typically yield a maximized emollient to pure surfactant ratio and will provide an end product having a pH of between 7 and 10.

Additionally, many natural and synthetic surfactants, mechanical agents and emollient agents can be added to the resulting surfactant composition if desired. It will be readily apparent to one skilled in the art that many other such variations of the process of the present invention can be employed, all of which can be construed to be within the scope of the present invention.

DETAILED DESCRIPTION OF THE INVENTION

The methods of the present invention involve the addition of processed plant material to solutions containing a source of either triglycerides or free fatty acids and reacting the mixture with an alkali base to produce saponified and/or reduced compositions having improved surfactant properties, mechanical cleaning properties and emollient properties.

Virtually any plant material may be added in the saponification methods of the present invention to produce improved surfactant compositions. However, grasses are described herein, and in the examples set forth below, as but one exemplar type of plant material which can be used. Grasses may be particularly suitable because of their cellulose structure and component molecules. Exemplar grasses include those of the family Poacea, which contain the varieties bluegrass, Bermuda grass, bent grass, fescue grass and some varieties of crabgrass such as bearded crouch grass, amongst others. To maximize the mechanical surfactant characteristics of the final product, it may be particularly desirable to use more fibrous varieties with lower oil and water content. Such grasses may include fescue grass, bluegrass, Bermuda grass or bearded couch grass as well as other varieties. For cosmetic quality surfactants, grasses which are less fibrous and higher in oil and water content are preferred, such as rye grass and bent grass. The plant or grass material is processed prior to adding it to the triglyceride or free fatty acid solution in order to enhance the reaction of the grass material with the alkali base solution. Processing the grass material produces a clean, contaminant-free biomass which provides a reaction interface for the alkali base solution. The preparation of plant material generally includes cleaning, milling, boiling, cold rinsing and draining the plant material to a substantially dry condition (some moisture remaining, but not wet). By way of example only, the following describes preparation of grass for use in the surfactant compositions:

EXAMPLE I

An amount of grass (e.g., 16 oz. by weight) was placed in a container and sufficient cold water was added to suspend the grass in the water. The resulting biomass of grass was milled by processing with an abrading element (e.g. industrial food processor) until the grass was sheared into smaller pieces (approximately 2 mm to 10 mm in length). The mixture was allowed to stand for one minute to allow the grass biomass to float to the top of the container and then the floating biomass was immediately removed, drained and pressed to remove excess moisture. Fresh water was brought to a gently rolling boil in a separate container and the biomass was added. The mixture was stirred and further milled using an abrading element, such as a mixer or food processor. The mixture was boiled for 15 to 20 minutes at approximately 214° F. and then the grass was immediately removed from the liquid. The grass should remain green in color and should not be allowed to rest in the liquid, but should be drained immediately. The resulting grass biomass was then drained and pressed to remove excess moisture. The grass was not completely dried, however. The grass biomass may be rinsed, drained and pressed once more, and may be refrigerated prior to use in the surfactant compositions. For grass biomass that is intended for addition to the surfactant composition after the saponification reaction, a preservative, preferably natural, may be added to the biomass. Such natural preservatives may include ascorbic acid, rosemary extract or mixed tocophenol (Vitamin E).

The triglycerides used in the present invention may be any of those triglycerides commonly used in the production of surfactant compositions including, but not limited to, triglycerides derived from lard, fish oil, coconut oil, olive oil, palm kernel oil, palm stearin oil, palm oil, tallow, tallow olein, tallow stearin, soya, hydrogenated soya and other like oils or fats. It should be noted that selection of a certain triglyceride source, or combination of sources, will provide a desired emollient character of the surfactant composition.

Alternatively, the free fatty acid solution of the present invention, may be composed of any of the free fatty acids commonly used in the production of surfactant compositions. These include, but are not limited to, lauric, myristic, palmitic, stearic and other carboxylic acids. Both the triglycerides and the free fatty acids preferably have alkyl groups within the 12 to 18 carbon range, and can be normal or branched, with a preference for normal alkyl groups.

Any suitable aqueous alkali base may be used to react with the triglyceride or free fatty acid solution in the present invention. Potassium hydroxide (KOH) or sodium hydroxide (NaOH) may be particularly suitable. Potassium hydroxide may be particularly suitable for the production of liquid, or less viscous surfactant compositions while sodium hydroxide may be more suitable for solidified surfactant compositions. However, either, or other, alkali base solutions may be employed.

Varying the ratio or percent of alkali base to triglyceride, free fatty acid/grass material solution will result in a surfactant composition having a selected moisturizing character. Thus, the percent of aqueous alkali base to triglyceride, free fatty acid/grass material solution may range from about 45% to about 65% when using potassium hydroxide or from about 30% to about 50% when using sodium hydroxide. The pH of the surfactant material will then range from between 7 to 10.

When using sodium hydroxide as the base for the aqueous lye solution, an amount of NaOH is mixed with water and is then cooled to room temperature, or about 28° C., before using in either a hot process or cold process, as described more fully below. When using potassium hydroxide as the base for the aqueous lye solution, an amount of KOH is mixed with water and is then cooled to approximately 60° C. prior to using a hot process as described more fully below.

The addition of non-reacted grass or plant material to the reacted solution following saponification provides a mechanical agent to the resulting surfactant composition which improves the cleaning characteristics of the composition in both solid and liquid form. That is, the non-reacted grass or plant material provides a solid component which mechanically contacts the skin's surface to remove dirt, oil and other particulate matter. Thus, the surfactants of the present invention exhibit increased cleaning capabilities when compared with other surfactant compositions.

Additional substances or materials may be added to the surfactant compositions of the present invention to further improve the cleaning and moisturizing characteristics of the compositions, as well as the esthetic character of the compositions, such as smell and color. It is preferred, however, that natural substances be employed as mechanical agents and fragrance or color enhancers or modifiers.

The present methods may be carried out by hot saponification processing, where the grass/oil mixture is heated to about 71° C. prior to mixing with the lye solution, or may be carried out by cold processing, where the grass/oil mixture is heated to about 45° C. prior to mixing with the lye solution. Further, the resulting surfactant compositions may be processed to a liquid form or a solid form as bars of soap. The reacted solution may also be processed to selectively increase the thickness and/or viscosity of the composition, as may be desired for a particular use.

The following examples describe various methods for producing surfactant compositions in accordance with the present invention. It will be readily understood that the methods of the present invention, as generally described herein, may be varied to produce surfactant compositions of varying character. Thus, the following examples of the methods of the present invention are not intended to limit the scope of the invention, but are merely representative of the presently preferred embodiments of the invention.

EXAMPLE II

A mixture was prepared containing 56 ounces by volume of olive oil and 48 ounces by weight of coconut oil. To the mixture of oils was added 48 ounces by weight of fibrous grass prepared in accordance with Example I, and the resulting mixture was heated to 71° C. A lye solution containing 24 ounces by weight of KOH in 60 ounces by weight of water was prepared. Notably, the reaction of KOH with water is an exothermic one which results in the lye solution reaching initial temperatures of 90° C. The lye solution then cools to about 60° C. The prepared lye solution was added to the oil and grass solution while stirring well.

After stirring the lye and oil/grass solution for fifteen minutes, the heat was reduced to 40° C. to allow the mixtures to react exothermally. The mixed solutions were stirred constantly for one hour and fifteen minutes. The stirred mixture, having formed a paste, was then placed in a double boiler and brought to a boil. While stirring occasionally, the mixture was boiled for 4 hours and fifteen minutes. The paste turned waxy in look and feel. The mixture was then cooled to room temperature and 128 ounces by weight of boiling water were added, along with 48 ounces by weight of preserved fibrous Bermuda grass prepared in accordance with Example I. The resulting diluted mixture was a thick liquid hand soap which is particularly suitable for heavy duty usage in such places as automotive garages and gardens.

EXAMPLE III

A reacted surfactant composition was prepared as set forth in Example II. The solution was then emulsified by adding 0.5 ounces by weight of a 33% Borax (sodium borate) boiling (100° C.) aqueous solution per pound of paste. The solution was stirred continuously for one hour to ensure emulsification.

EXAMPLE IV

A lye solution was prepared by mixing 17 ounces by weight of potassium hydroxide with 40 ounces by weight of distilled water and the solution was allowed to cool to a temperature of 60° C. Thirty-two ounces by weight of bentgrass, prepared in accordance with Example I, was added to 40 ounces by weight of olive oil and 32 ounces by weight of coconut oil. The oil and grass mixture was heated to 71° C. The lye solution was then added to the oil and grass mixture and stirred for 15 minutes while applying heat to the admixture. The heat was then reduced to 40° C. and the admixture was stirred for 40 minutes until pasty in consistency. The thickened mixture was then placed in a double boiler and brought to a low boil. The mixture was stirred at a low boil for three and one half hours after which the mixture had the consistency of pasty chunks. To the mixture was then added 12 ounces by weight of water, 16 ounces by weight of glycerin and 4 to 5 ounces by weight of ethanol. The solution was stirred carefully, and foaming was controlled by occasional spraying with 90% isopropyl alcohol, until the pasty chunks dissolved to a liquid consistency (about 20 to 30 minutes). Forty ounces by weight of preserved grass, prepared in accordance with Example I, were then added and the composition was cooked and stirred an additional thirty minutes. Approximately one ounce by weight of a fragrance was added upon cooling. The composition was a thickened liquid having a gelled consistency.

EXAMPLE V

A lye solution containing 22 ounces by weight of KOH in 60 ounces by weight of water was mixed and then allowed to cool to 60° C. Between 16 ounces and 24 ounces by weight of bluegrass, prepared according to Example I, were added to 56 ounces by weight of olive oil and 48 ounces by weight of coconut oil and the mixture was stirred and heated to 71° C. The mixture underwent saponification. The mixture was stirred constantly to ensure that the grasses were thoroughly mixed in solution. After fifteen minutes of heating, the temperature was reduced to 40° C. to allow the exothermic reaction to continue. After one hour and fifteen minutes, the mixture, now pasty, was placed in a double boiler and brought to a low boil (214° C.). Following three hours of low boiling and occasional stirring, the mixture was waxy and non-tacky. The mixture was allowed to cool to room temperature and was then diluted with 100 ounces by weight of boiling water. The mixture was then allowed to cool completely. The resulting liquid soap solution is particularly suitable for cosmetic purposes (e.g., face soap, makeup remover, shampoo, etc.) because of it gentleness. The foregoing composition may be made using sodium hydroxide as the basis for the lye solution.

EXAMPLE VI

A lye solution was prepared by adding 22 ounces by weight of NaOH to 58 ounces by weight of water. The lye solution was allowed to stand for 5 to 6 hours at room temperature. Thirty-two ounces by weight of coconut oil, 32 ounces by weight of olive oil and 64 ounces by weight of lard were combined with 64 ounces by weight of couch grass, prepared in accordance with Example I, and the mixture was heated to 50° C. The mixture was then removed from the heat. The lye solution was added to the oil, lard and grass mixture and was stirred vigorously while allowing the saponification reaction to proceed. After ten minutes of vigorous stirring, approximately one ounce by weight of fragrance was added and the mixture was stirred. The mixture was continuously stirred for twenty-five minutes, during which time the mixture "traced." As is well known in the art, "tracing" is the stage during saponification when the solution exhibits signs of starting to thicken and the time is appropriate for pouring the solution into molds for thickening. The thickened mixture was immediately poured into molds, was covered, and allowed to stand for 24 hours. The molded soap was then cut into smaller sizes of product; however, cutting the soap is optional. Thereafter, the hardened soap was removed from the molds and was allowed to cure for up to an additional four weeks.

EXAMPLE VII

A mixture of oils, lard and grass was prepared and saponified as set forth in Example VI. While adding fragrance, however, an additional amount of grass, prepared in accordance with Example I and ranging from between eight ounces and twenty-four ounces by weight, was added to the saponifying mixture. The prepared grass (a more fibrous fescue or couch grass, for example) was comprised of cut pieces of grass approximately 4 to 8 mm in length. The mixture was then placed in molds and cured according to Example VI.

EXAMPLE VIII

A lye solution was prepared combining seven ounces by weight of NaOH with fourteen ounces by weight of water. The lye solution was allowed to cool to room temperature (approximately three to four hours). To twenty-four ounces by weight of coconut oil and 20 ounces by weight of olive oil were added 30 ounces by weight of couch grass prepared in accordance with Example I. The solution was heated to 71° C. The lye solution was then added and stirred constantly for fifteen minutes. The heat was then reduced to 40° C. and the mixture began to "puff" in an exothermic reaction. The reaction continued for 25 minutes at which time the puffing subsided. The mixture was then placed in a double boiler and was brought to a gentle boil. The mixture was gently boiled for three hours while being constantly stirred and was then removed from the heat and allowed to cool. The mixture was stirred constantly and began to thicken as it cooled. After the mixture thickened (approximately three hours), it was pressed into bars and was allowed to stand for one week. The bar soap made by this method proved to be particularly suitable for use in removing difficult dirt and oils (e.g., automotive grease) from the hands while not causing dermatitis.

EXAMPLE IX

A lye solution was prepared by combining 12 ounces by weight of NaOH with 24 ounces by weight of water. The lye solution was then allowed to cool to room temperature (approximately six hours). Forty-eight ounces by weight of olive oil and 28 ounces by weight of coconut oil were mixed with sixteen ounces of rye grass which had been prepared in accordance with Example I. The mixture was heated to 71° C. and the lye solution was added to initiate the saponification reaction. The mixture was vigorously stirred for fifteen minutes and then the temperature was reduced to 40° C. The saponification reaction was allowed to continue for about forty minutes. The mixture was then stirred for an additional hour and thirty minutes until the mixture turned thick. The mixture was placed in a double boiler and was allowed to boil gently for 3 hours. The mixture was then removed from the heat and was immediately pressed into bars. The molded mixture was allowed to cool to room temperature an additional 24 hours. The solidified soap was then removed from the molds and was cured for up to one week. The resulting soap is particularly useful as a beauty bar. The resulting soap may also be diluted for use as a liquid soap.

EXAMPLE X

Twenty ounces by weight of sodium hydroxide were added to 64 ounces by weight of water and stirred. The solution, heated as a result of the exothermic nature of the reaction, was allowed to cool to room temperate (about 28° C.). In a separate container, 64 ounces by weight of lard, 64 ounces by weight of bluegrass prepared in accordance with Example I, 30 ounces by weight of coconut oil and 34 ounces by weight of olive oil were added together and heated to about 45° C. The grass solution was then removed from the heat and the lye solution was added while the grass solution was still hot. The admixture of lye and grass solutions was vigorously stirred for 15 minutes, at which time the solution began to trace. The solution was stirred a further 12 to 25 minutes or until the solution was fully traced. The solution was then poured into molds for solidification. The soap was cured for 24 to 48 hours and then removed from the mold for cutting into smaller portions. The bars may be cured for additional 2 to 4 weeks.

Surfactant compositions prepared in accordance with the previous Examples were tested by groups of individuals in comparison with known soaps of similar type or consistency. It was found that surfactants prepared in accordance with Examples II–IV were more effective than known abrasive-containing soaps in removing grease and oils, such as automotive grease, oil and dirt, and cleaned without irritating the skin. No dermatitis or other skin conditions arising from reaction to the surfactant composition were observed in any test subject. Test subjects who were asked to use and compare the surfactant composition prepared in accordance with Examples V, VI and IX reported that the composition effectively removed dirt and makeup from their faces while not irritating the skin. The test subjects reported that the composition of the invention was more effective than known beauty or cosmetic soaps.

The methods of preparing surfactant compositions containing plant materials, and the surfactant compositions, disclosed herein may be adapted to any number of cleaning purposes, including facial or cosmetic soaps, hand and body soaps, industrial hand cleaners and household cleaners. Those skilled in the art will recognize that the methods and compositions described herein may be modified to meet those specific objectives or intended purposes. Thus, reference herein to specific details of methods or compositions is by way of reference only and is not intended to limit the scope of the invention as set forth in the claims.

What is claimed is:

1. A method for producing surfactant compositions comprising:

preparing an alkali base solution for reacting with a triglyceride or free fatty acid solution;

preparing a mixture containing fibrous plant material in combination with a source of triglyceride or free fatty acids;

heating said plant material mixture to about 45° C.;

mixing said alkali base solution with said mixture containing plant material and source of triglyceride or free fatty acids; and reacting said mixture to form a surfactant composition containing reacted plant material.

2. The method according to claim 1 wherein said alkali base solution is an aqueous solution of potassium hydroxide.

3. The method according to claim 1 wherein said alkali base solution is an aqueous solution of sodium hydroxide.

4. The method according to claim 1 wherein said source of triglycerides is selected from the group consisting of lard, fish oil, coconut oil, olive oil, palm kernel oil, palm stearin oil, palm oil, tallow, tallow olein, tallow stearin, soya, hydrogenated soya and combinations thereof.

5. The method according to claim 4 wherein said reaction is saponification.

6. The method according to claim 1 wherein said source of free fatty acids is selected from the group consisting of lauric acid, myristic acid, palmitic acid, stearic acid and combinations thereof.

7. The method according to claim 6 wherein said free fatty acids are reacted to carboxylic acid salts.

8. The method according to claim 1 further comprising adding to the reacted mixture up to fifty percent by weight of plant material.

9. The method according to claim 8 wherein said added plant material is preserved.

10. The method according to claim 8 wherein said added plant material is grass.

11. The method according to claim 1 further comprising diluting said reacted mixture to form a liquid soap.

12. The method according to claim 11 further comprising adding up to fifty percent by weight of plant material to said reacted mixture.

13. The method according to claim 1 further comprising emulsifying said reacted mixture.

14. The method according to claim 1 further comprising curing said reacted mixture for a selected time to form a solidified surfactant material.

15. A method for producing surfactant compositions comprising:

preparing an aqueous lye solution for reacting with a triglyceride or free fatty acid solution;

preparing a mixture containing plant material in combination with a source of triglycerides;

heating said mixture of plant material and source of triglycerides to about 71° C.;

adding said lye solution to said heated plant mixture;

allowing said lye solution and plant material mixture to cool to about 60° C.; and stirring said lye solution and mixture to initiate a saponification reaction.

16. The method according to claim 15 further comprising heating said reacted lye and plant mixture to form a thickened composition.

17. The method according to claim 16 further comprising diluting said thickened composition.

18. The method according to claim 16 wherein said thickened composition is emulsified.

19. The method according to claim 1 wherein the source of said trigycleride is processed to yield the triglycerides which are at least in part alkoxylated.

20. A method for producing surfactant compositions comprising:

preparing an alkali base solution for reacting with a triglyceride or free fatty acid solution;

preparing a mixture containing plant material of at least one grass specie in combination with a source of triglyceride or free fatty acids;

heating said plant material mixture to about 45° C.;

mixing said alkali base solution with said mixture containing plant material and source of triglyceride or free fatty acids; and reacting said mixture to form a surfactant composition containing reacted plant material.

21. The method according to claim 20 wherein said grass is processed prior to mixing with said source of triglyceride or free fatty acid by:

cleaning a selected quantity of grass;

mixing said grass with water and stirring to bring said grass into solution;

milling said grass while in solution;

removing a milled biomass of grass which has floated to the top of said solution;

adding said biomass to a quantity of boiling water and boiling for a selected time;

draining said biomass; and pressing said biomass to remove excess water.

22. The method according to claim 20 wherein said grass is of the family Poacea.

23. A method for producing surfactant compositions comprising:

preparing an alkali base solution for reacting with a triglyceride or free fatty acid solution;

preparing a mixture containing plant material in combination with a source of triglyceride or free fatty acids;

heating said plant material mixture to about 45° C.;

mixing said alkali base solution with said mixture containing plant material and source of triglyceride or free fatty acids;

reacting said mixture to form a surfactant composition containing reacted plant material; and adding up to fifty percent by weight of plant material to said reacted mixture.

24. The method according to claim 23 herein said added plant material is preserved.

25. The method according to claim 23 wherein said added plant material is grass.

26. The method according to claim 23 further comprising diluting said reacted mixture to form a liquid soap.

27. The method according to claim 23 further comprising emulsifying said reacted mixture.

28. The method according to claim 23 further comprising curing said reacted mixture for a selected time to form a solidified surfactant material.

* * * * *